US007686712B2

(12) United States Patent
Sifrit

(10) Patent No.: US 7,686,712 B2
(45) Date of Patent: Mar. 30, 2010

(54) SOCCER GOAL WITH SUNSHADE

(76) Inventor: Robert Sifrit, 1203 W. Marian Ave., Punta Gorda, FL (US) 33950

( * ) Notice: Subject to any disclaimer, the term of this patent is extended or adjusted under 35 U.S.C. 154(b) by 275 days.

(21) Appl. No.: 11/880,800

(22) Filed: Jul. 24, 2007

(65) Prior Publication Data

US 2009/0029807 A1 Jan. 29, 2009

(51) Int. Cl.
*A63B 69/00* (2006.01)

(52) U.S. Cl. ..... 473/478; 473/421; D21/699

(58) Field of Classification Search ..... 473/478, 473/436, 421; 135/117, 88.08; 273/400, 273/172 R; 52/3; D21/699
See application file for complete search history.

(56) References Cited

U.S. PATENT DOCUMENTS

| | | | | | |
|---|---|---|---|---|---|
| 2,024,090 | A | * | 12/1935 | Cadmus | 160/180 |
| 4,286,786 | A | * | 9/1981 | Papadopoulos | 473/432 |
| 4,420,158 | A | * | 12/1983 | Klock et al. | 473/478 |
| 4,930,534 | A | * | 6/1990 | Hill | 135/136 |
| 5,524,901 | A | | 6/1996 | Bison et al. | |
| 5,553,648 | A | * | 9/1996 | Goharjou | 160/135 |
| 5,863,266 | A | | 1/1999 | Starnes | |
| 6,165,085 | A | | 12/2000 | Lubin | |
| 6,789,557 | B1 | * | 9/2004 | Wahl, Jr. | 135/154 |
| 6,796,359 | B1 | * | 9/2004 | Knutson | 160/156 |
| D562,418 | S | * | 2/2008 | Sifrit | D21/699 |
| 2009/0029807 | A1 | * | 1/2009 | Sifrit | 473/478 |

FOREIGN PATENT DOCUMENTS

CA 2401415 * 3/2004

* cited by examiner

*Primary Examiner*—Gene Kim
*Assistant Examiner*—Mike Chambers
(74) *Attorney, Agent, or Firm*—Charles J. Prescott

(57) ABSTRACT

A temporary sunshade for a soccer goal which has a net and a goal frame for supporting the net in an outstretched configuration, the outstretched net having contiguous generally planar net surfaces including a horizontal top panel, upright end panels, and a sloping back panel. The sunshade preferably includes a removable flexible sunscreen connectable atop preferably all of the outstretched net as a sunshade for players during periods of soccer play inactivity. The sunscreen includes an airflow opening in a back panel thereof which permits moving air to flow there through for cooling players within the goal space of the soccer goal while remaining shaded. In one aspect, the opening may be an elongated slit formed along a substantial length of the back panel of said sunscreen. In another aspect, the opening may be a plurality of spaced U-shaped cuts through the back panel of the sunscreen each defining a flap movable by air movement thereagainst which produces an opening to permit air to flow there through.

1 Claim, 6 Drawing Sheets

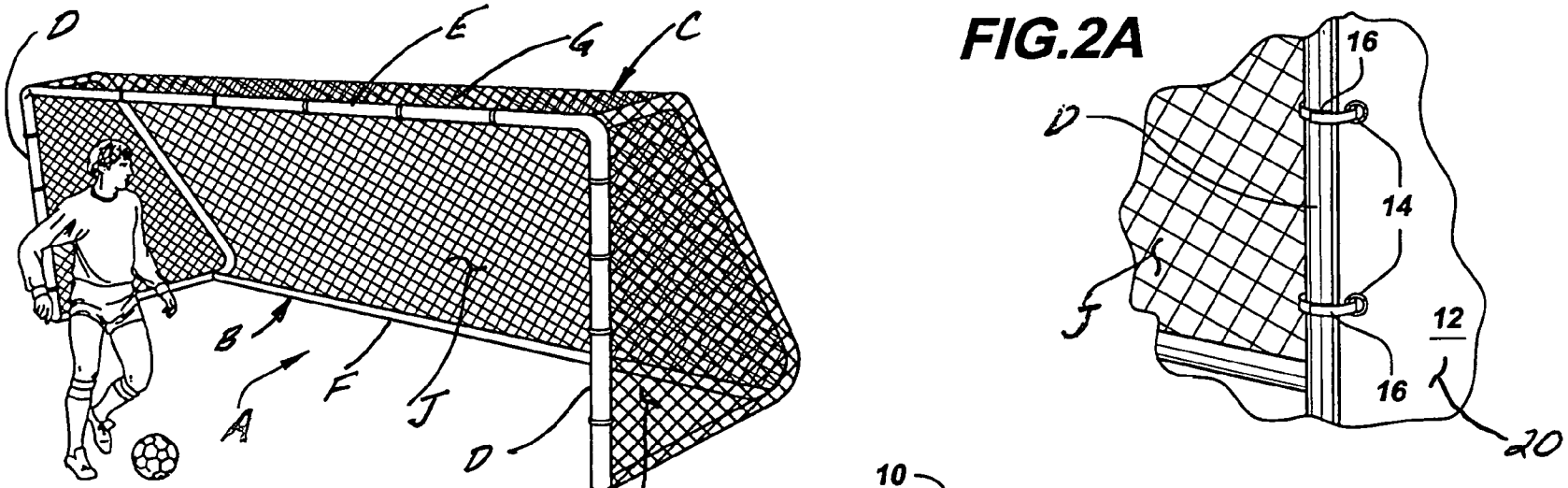
FIG.1
FIG.2A
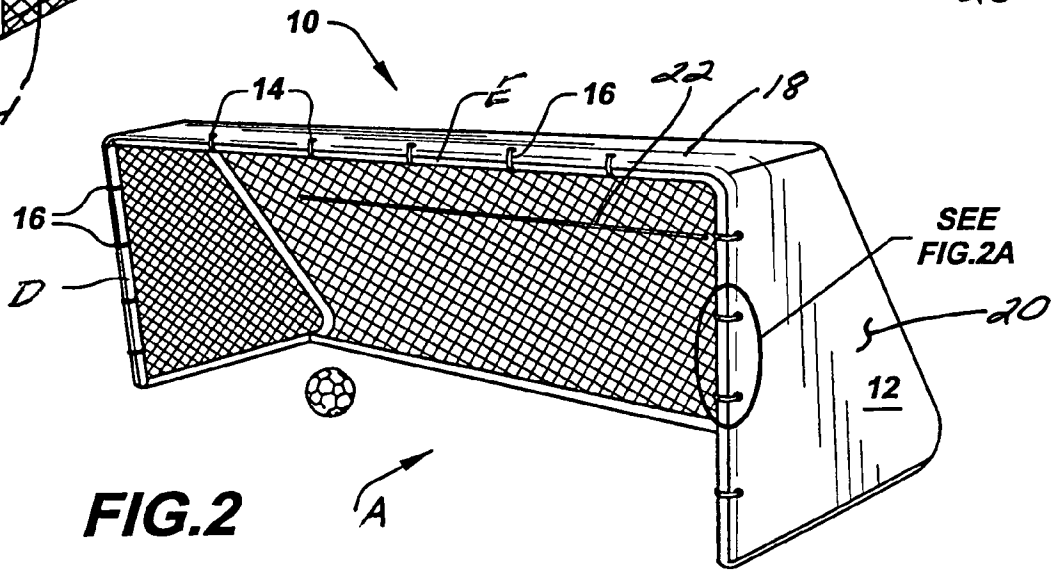
FIG.2

SOCCER GOAL WITH SUNSHADE

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to soccer goals and more particularly to an improved soccer goal which provides shade for players when the soccer goal is not in competitive use.

2. Description of Related Art

A number of soccer goals having additional features beyond the basic structural features required of a soccer goal are known in prior art. U.S. Pat. No. 5,863,266 to Starnes teaches a soccer goal having a cover which may be used in a first position away from the opening prior to scoring and in a second position across the opening after scoring.

Lubin discloses a soccer goal in U.S. Pat. No. 6,165,085, the improvement comprising an intermediate crossbar having a first end for attachment to the first diagonal strut and a second end for attachment to the second diagonal strut to create a backstop portion. Bison, et al. discloses a sport target apparatus having a back panel in U.S. Pat. No. 5,524,901 and a soccer shooting training target is taught by Leras, et al. in U.S. Pat. No. 5,181,725.

U.S. Pat. No. 4,921,257 to Heller teaches a soccer-training device and Papadopolos discloses a soccer-training goal in U.S. Pat. No. 4,286,786. A number of design patents disclosed in the Information Disclosure Statement each having distinctive ornamental features are also taught in prior art.

The present invention allows a conventional soccer goal to be temporarily converted into a sunscreen beneath which and within the goal space itself, players may obtain relief from direct sunlight during periods when the goal is not being used for direct competition or practice. Additionally, a soccer goal which is not in use may be positioned over a bench area on the sidelines of a soccer field and temporarily covered by the sunshade to provide a "dugout-type" arrangement for the players and coaches during games.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This invention is directed to a temporary sunshade for a soccer goal which has a net and a goal frame for supporting the net in an outstretched configuration, the outstretched net having contiguous generally planar net surfaces including a horizontal top panel, upright end panels, and a sloping back panel. The sunshade preferably includes a removable flexible sunscreen connectable atop preferably all of the outstretched net to shade players during periods of soccer play inactivity. The sunscreen itself includes an airflow opening in a back panel thereof which permits moving air to flow there through for cooling players within the goal space of the soccer goal while remaining shaded. In one aspect, the opening may be an elongated slit formed along a substantial length of the back panel of said sunscreen. In another aspect, the opening may be a plurality of spaced U-shaped cuts through the back panel of the sunscreen each defining a flap movable by air movement thereagainst which produces an opening to permit air to flow there through.

It is therefore an object of this invention to provide a sunshade arrangement for a soccer goal which, when temporarily deployed, will provide a shaded area for players when the soccer goal is otherwise not in use.

Yet another object of this invention is to provide an easily deployable and removable sunscreen for a soccer goal which will temporarily shade players seeking refuge from the heat of the sun.

Still another object of this invention is to provide a sunscreen for players positioned within the goal space of a soccer goal with added cooling benefits of airflow freely passing therethrough.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference of the drawings and by study of the following descriptions.

BRIEF DESCRIPTION OF THE SEVERAL VIEWS OF THE DRAWING(S)

FIG. 1 is a perspective view of a conventional soccer goal.

FIG. 2 is a perspective view of FIG. 1 showing one embodiment of a sunscreen of this disclosure disposed thereover with a detailed view.

FIG. 2*a* is an enlarged detail view showing attachment of the sunscreen to the upright goal posts of FIG. 2.

Figure 3:
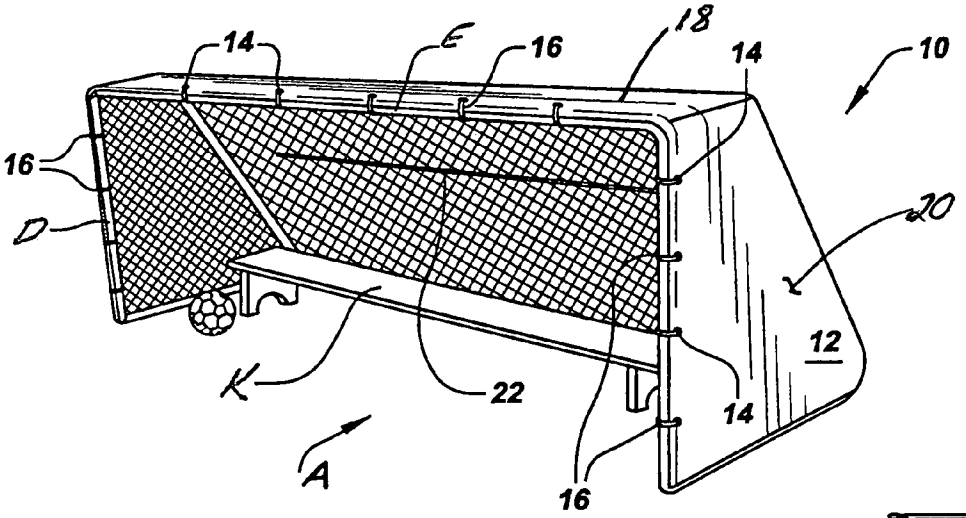

FIG. 3 is a perspective view similar to FIG. 2 showing the soccer goal positioned over a bench for use as a "dugout".

Figure 4:
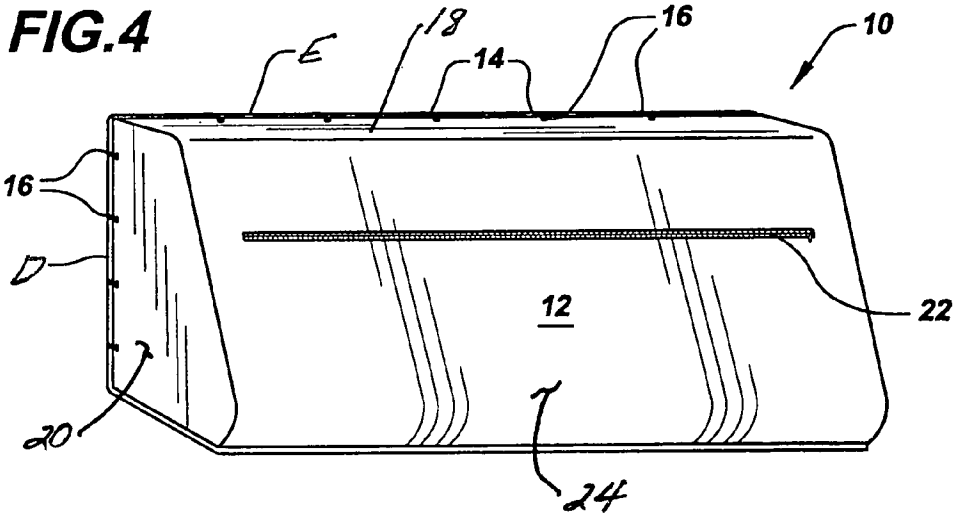

FIG. 4 is a rear perspective view of FIG. 3.

Figure 5:
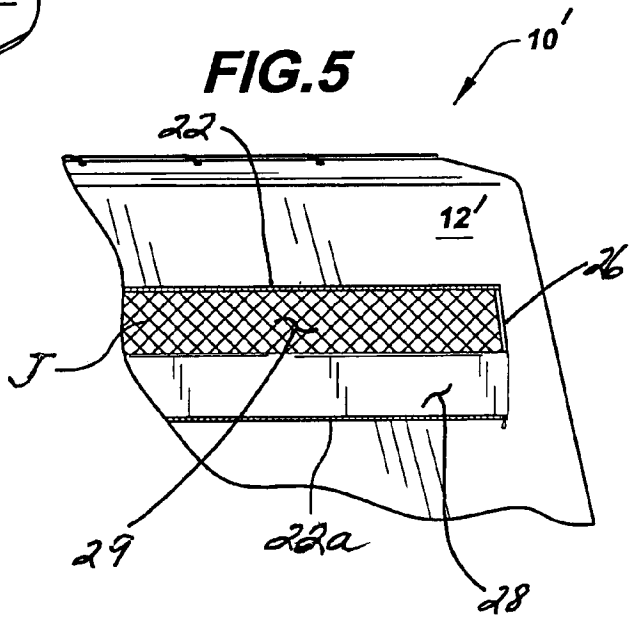

FIG. 5 is an enlarged fragmented view of an alternate embodiment of the sunscreen.

Figure 6:
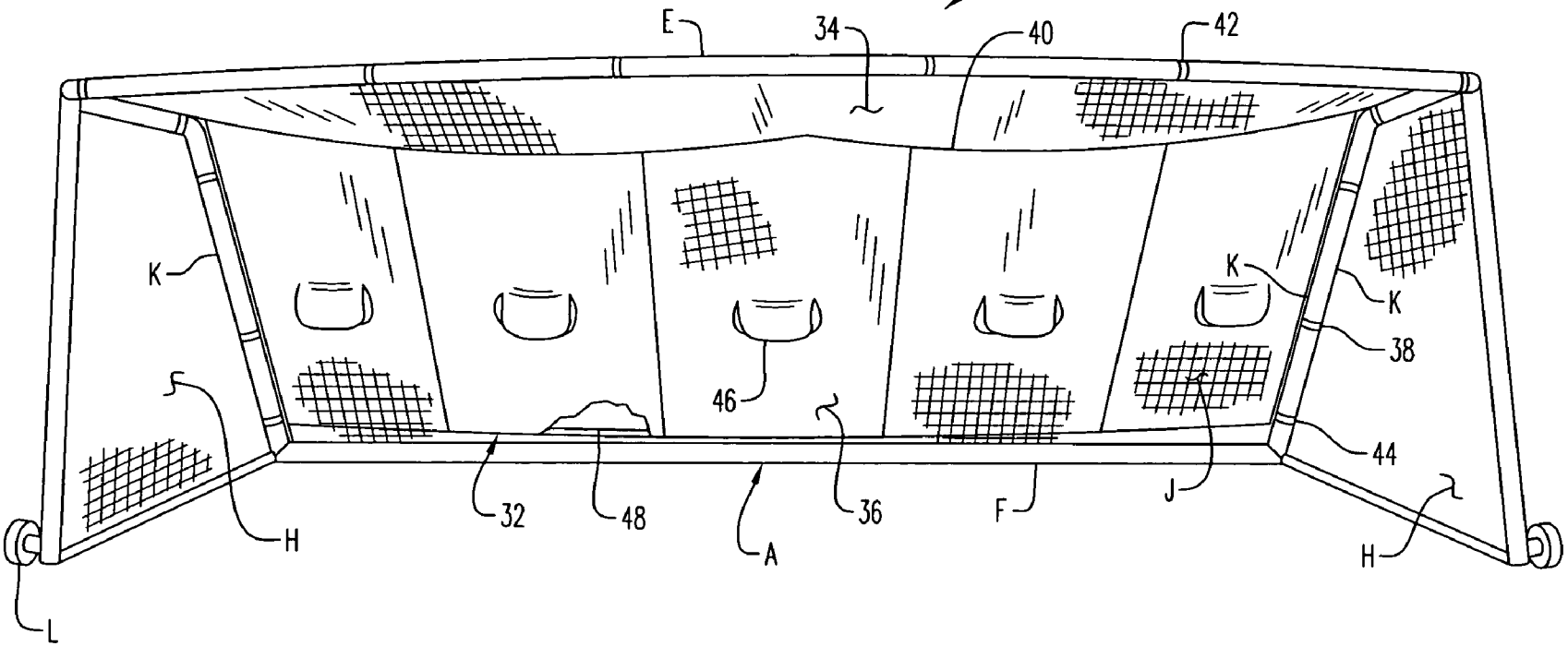

FIG. 6 is a front perspective broken view of a preferred embodiment of the sunshade.

Figure 7:
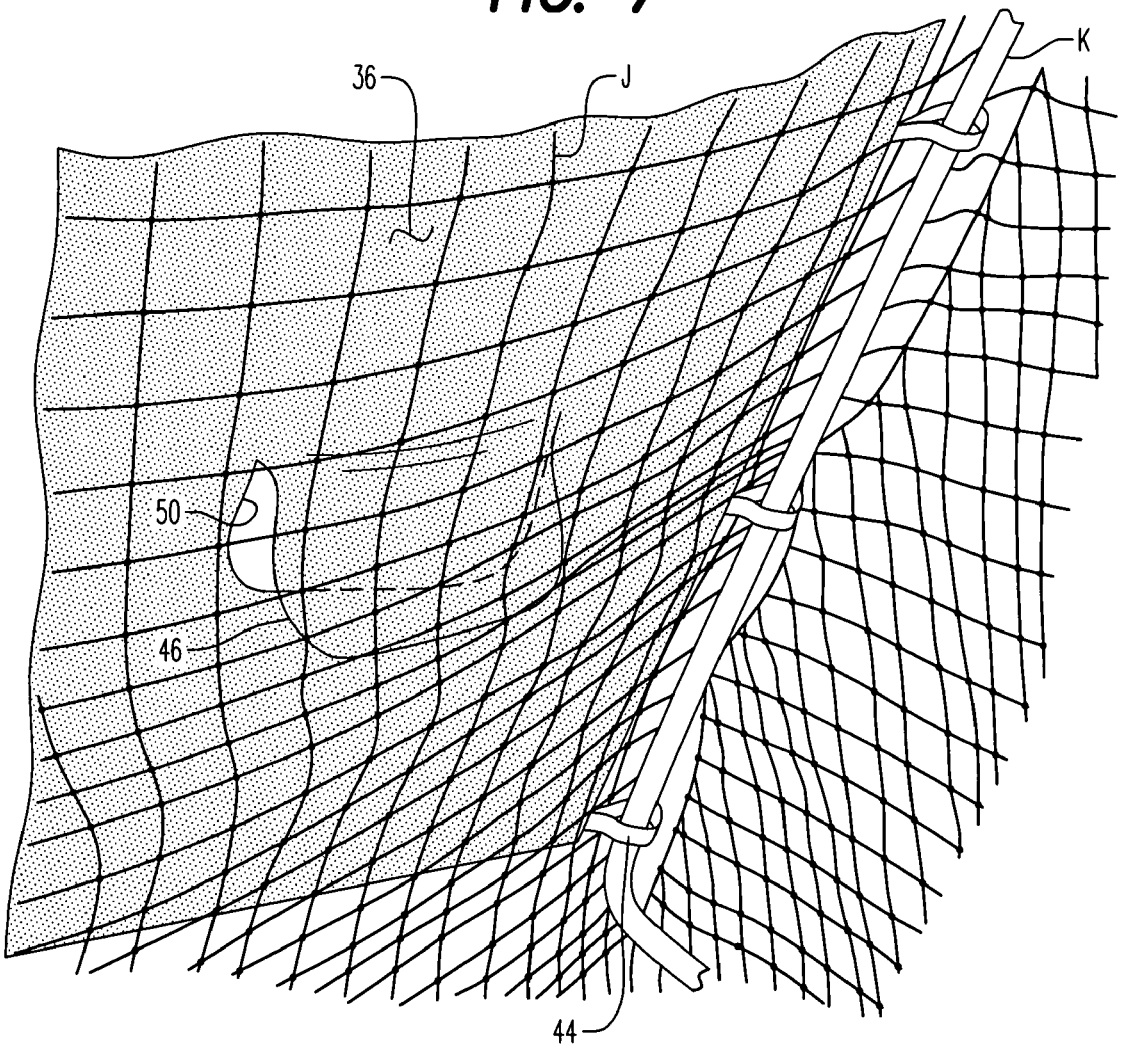

FIG. 7 is an enlarged fragmented view of a central portion of FIG. 6.

Figure 8:
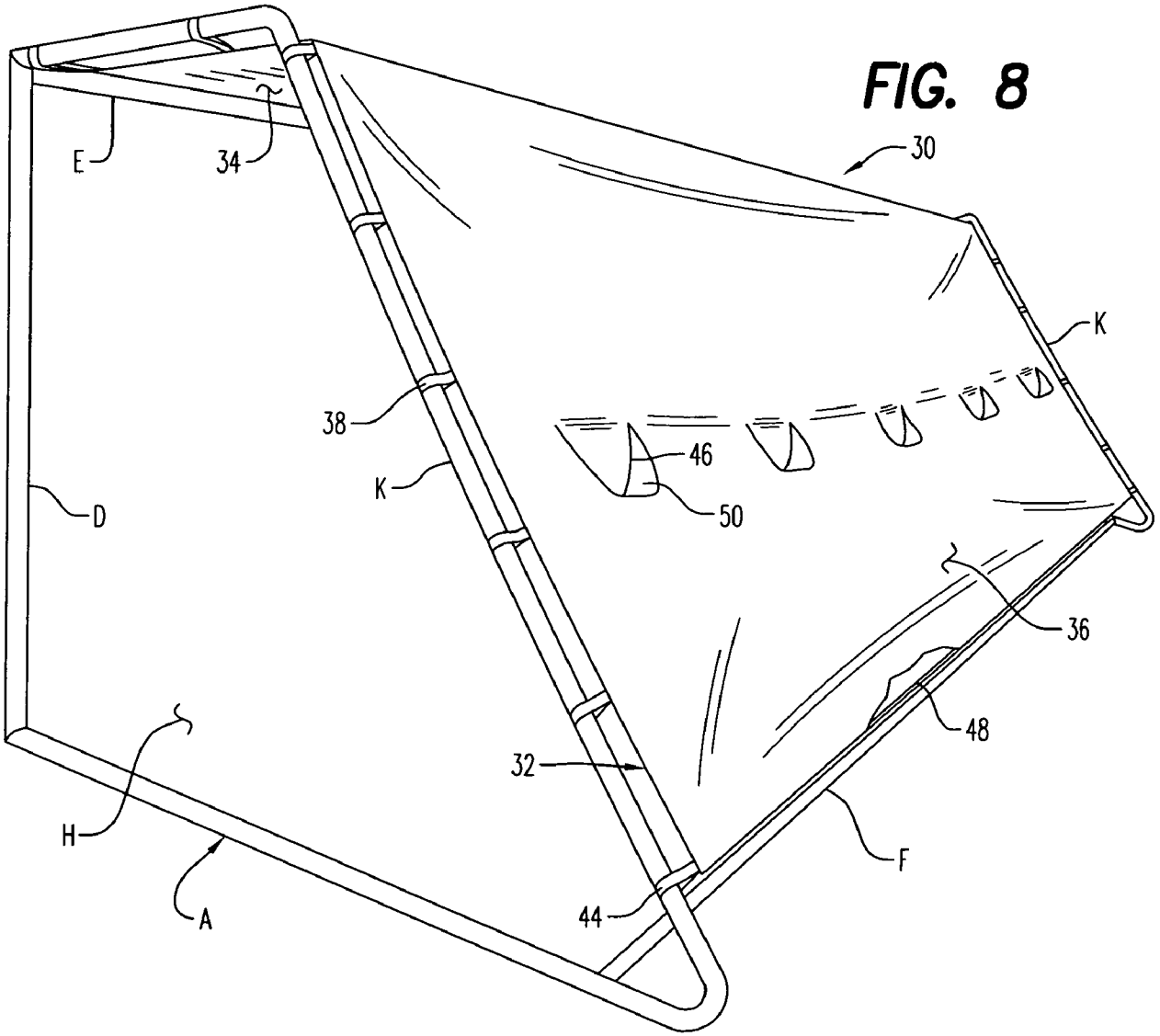

FIG. 8 is a rear perspective view of FIG. 6 absent the net for clarity.

Figure 9:
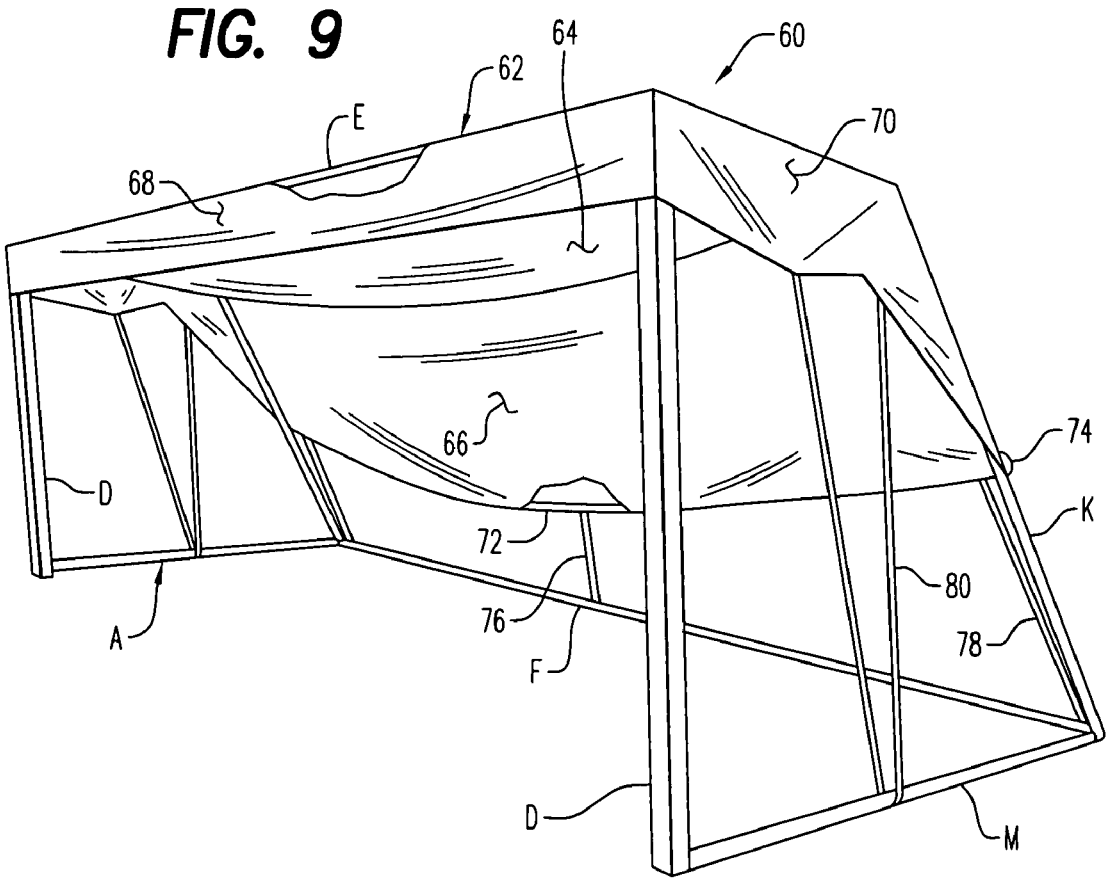

FIG. 9 is a perspective view of another embodiment of the sunshade absent the soccer net for clarity.

Exemplary embodiments are illustrated in reference figures of the drawings. It is intended that the embodiments and figures disclosed herein are to be considered to illustrative rather than limiting.

DETAILED DESCRIPTION OF THE INVENTION

Referring now to the drawings, and particularly to FIGS. 1 to 4, a conventional or standard soccer goal is shown generally at numeral A which includes a tubular goal frame B and a net C laid over and attached to the frame as shown by VELCRO straps or conventional tie wrap means. The goal frame B includes an upper cross member E, upright goal posts D and a lower cross bar F. The net C includes a top panel G, side panels H and back panel J which are contiguous or continuous one to another so as to form a goal space between and behind the plane defined by the upright goalposts D.

The sunshade 10 includes a sunscreen 12 which is preferably formed of either flexible lightweight canvas material or screen mesh having a sufficiently fine weave so as to substantially block sunlight from passing therethrough. The preferred fabric material is known under the trademark as PHIFERTEX available from the Phifer Corporation. This sunscreen 12 includes a top panel 18, side panels 20 and a sloping back panel 24 which are substantially contiguous and similar in shape and configuration to all of the corresponding panels of the goal net C. The sunscreen 12 is secured as best seen in FIGS. 2 and 2A utilizing VELCRO strip 16 which interengage between the corresponding goal frame members and grommets 14 formed adjacent the corresponding margin of each of the corresponding panels of the sunscreen 12.

To enhance the cooling benefits of this device, moving air or breeze will flow therethrough by opening an elongated zipper 22 formed through and attached to the back panel 24 of the sunscreen 12. When the zipper 22 is opened, air is allowed to flow through the goal space to enhance the cooling and protective benefits for players seated within the goal space.

In FIG. 5, an alternate embodiment of the airflow opening 29 is there shown wherein a side slit 26 is also provided so that a flap 28 is formed and falls downwardly into the position shown with the zipper portions 22 and 22*a* separated to produce the larger airflow opening 29.

Referring now to FIGS. 6, 7 and 8, another and preferred embodiment of the invention is there shown generally at numeral 30 which includes the soccer goal A as previously described and a sunscreen 32 which includes only a back panel 36 and a top panel 34 connected together along a common horizontal upper seam 40. The top panel 34 is connected by VELCRO straps 42 to the upper cross frame E while the strap-reinforced lower margin 48 is connected to the back sloping frame members K also by VELCRO strips 44 after being tensioned to eliminate the need for an upright mid strap attached to the lower margin 48. The net side panels H (not shown for clarity) are left open for enhanced airflow and visibility while substantially all of the sunshade benefits are retained by this embodiment 32.

To enhance airflow through the goal spaced defined by this arrangement, a series of spaced flaps 46 are formed through the back panel 36 by forming a generally U-shaped cut 50 as best seen in FIG. 7. Thus, when wind is blowing through the goal space, the flaps 46 will easily move in the direction of the airflow to allow cooling air to flow through the goal space. Additional airflow will pass between the lower edge 48 of the sunscreen 32 and the lower cross member F of the goal frame A.

Referring now to FIG. 9, another alternate embodiment of the invention is there shown generally at numeral 60 and includes the goal frame A previously described and a sunscreen 62 formed of flexible canvas or tight-mesh fabric material as previously described. In this embodiment 62, a top panel 64 is provided along with a back panel 66 which extends part way down the net back panel J of the goal net C (not shown for clarity). A front panel 68 (contiguous with the top panel 64) and shortened side panels 70 form fit around the front upper crossbar E and the upright goalposts D to eliminate the need for tie-downs for the sunscreen 62 in this area. Only a single lateral tie-down arrangement at 74 is required which applies tension to the reinforced lower margins 72 of the back panel 66. However, vertical straps 76, 78 and 80 may be provided where additional tension or attachment rigidity may be required in windy environments.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. A method of providing shade and substantially uninhibited player-cooling airflow for soccer players comprising:

positioning and attaching a soccer goal net over a soccer goal frame to form a soccer goal, the net and the frame defining generally planar net surfaces including a horizontal top panel, a sloping back panel and upright end panels;

positioning and attaching a flexible opaque sunscreen sized to be generally equal to and to be positionably over the horizontal top panel and the sloping back panel;

providing airflow openings formed through the back panel and substantially covering said back panel for allowing moving air to flow through the soccer goal net to cool players within the soccer goal;

shading soccer players by positioning the players within the soccer goal, shade being provided by the sunscreen.

* * * * *